US009091501B2

(12) United States Patent
Pichler

(10) Patent No.: US 9,091,501 B2
(45) Date of Patent: Jul. 28, 2015

(54) FORWARD SET TRIGGER DEVICE

(71) Applicant: Harald Pichler, Gaflenz (AT)

(72) Inventor: Harald Pichler, Gaflenz (AT)

(73) Assignee: Steyr Mannlicher GmbH, Kleinraming (AT)

( * ) Notice: Subject to any disclaimer, the term of this patent is extended or adjusted under 35 U.S.C. 154(b) by 0 days.

(21) Appl. No.: 14/379,534

(22) PCT Filed: Jan. 24, 2013

(86) PCT No.: PCT/AT2013/050020

§ 371 (c)(1),
(2) Date: Aug. 19, 2014

(87) PCT Pub. No.: WO2013/123538

PCT Pub. Date: Aug. 29, 2013

(65) Prior Publication Data

US 2015/0068091 A1 Mar. 12, 2015

(30) Foreign Application Priority Data

Feb. 20, 2012 (AT) ..... GM50011/2012

(51) Int. Cl.
*F41A 19/10* (2006.01)
*F41A 19/17* (2006.01)
(Continued)

(52) U.S. Cl.
CPC . *F41A 19/10* (2013.01); *B60K 1/00* (2013.01); *B60K 1/02* (2013.01); *F41A 19/17* (2013.01); *F41A 19/52* (2013.01); *H02K 9/19* (2013.01);
(Continued)

(58) Field of Classification Search
CPC ..... F41A 19/10; F41A 19/17; F41A 19/52
USPC ..... 42/69.01–69.03, 65; 89/1.41, 27.11
See application file for complete search history.

(56) References Cited

U.S. PATENT DOCUMENTS 1,363,971 A * 12/1920 Hazelton ..... 89/133
1,840,478 A * 1/1932 Von Frommer ..... 42/47
(Continued)

FOREIGN PATENT DOCUMENTS

DE 3436401 10/1984
DE 29709330 5/1997
(Continued)

OTHER PUBLICATIONS

Austrian Office Action for GM 50011/2012 dated Apr. 11, 2013.
(Continued)

*Primary Examiner* — Bret Hayes
(74) *Attorney, Agent, or Firm* — Hoffman & Baron, LLP

(57) ABSTRACT

A forward set trigger device for a firearm, includes a striking element that is acted upon by a main spring and has a catch interacting with a locking element, which can be disengaged from the catch by a trigger blade via a release member. The forward set trigger further includes an uncocking mechanism for the main spring by means of which a main spring support facing away from the striking element can be brought into a position that uncocks the main spring. A forward setting mechanism having a spring element, is articulated to the trigger blade and supported on a stop and which can be brought into an unstable cocked position during a forward setting movement of the trigger blade, and wherein the uncocking mechanism brings the spring element out of its unstable cocked position when the main spring support is moved into the uncocked position.

18 Claims, 2 Drawing Sheets

(51) Int. Cl.

| | |
|---|---|
| ***F41A 19/52*** | (2006.01) |
| ***B60K 1/00*** | (2006.01) |
| ***B60K 1/02*** | (2006.01) |
| ***H02K 9/19*** | (2006.01) |

(52) U.S. Cl.
CPC ..... *B60K 2001/003* (2013.01); *B60K 2001/006* (2013.01)

(56) References Cited

U.S. PATENT DOCUMENTS

| | | | | | |
|---|---|---|---|---|---|
| 1,900,184 | A | * | 3/1933 | Loomis | 42/41 |
| 2,626,476 | A | * | 1/1953 | Miller | 42/69.03 |
| 2,908,098 | A | * | 10/1959 | Picollo | 42/43 |
| 3,102,354 | A | * | 9/1963 | Harding | 42/41 |
| 3,791,061 | A | * | 2/1974 | Tirone | 42/41 |
| 3,949,508 | A | * | 4/1976 | Elkas | 42/69.03 |
| 4,026,056 | A | * | 5/1977 | Roman | 42/69.01 |
| 4,625,444 | A | | 12/1986 | Beretta | |
| 4,811,509 | A | * | 3/1989 | Beretta | 42/42.01 |
| 5,052,141 | A | * | 10/1991 | Sammons | 42/69.01 |
| 5,311,692 | A | * | 5/1994 | Blaser | 42/42.01 |
| 5,657,567 | A | * | 8/1997 | Beretta | 42/41 |
| 5,680,722 | A | * | 10/1997 | French et al. | 42/69.03 |
| 6,796,067 | B2 | * | 9/2004 | Popikow | 42/42.01 |
| 7,347,021 | B1 | * | 3/2008 | Jones | 42/10 |
| 2003/0070342 | A1 | * | 4/2003 | Baker et al. | 42/69.03 |
| 2008/0120887 | A1 | * | 5/2008 | De Gregorio | 42/69.01 |
| 2012/0090450 | A1 | * | 4/2012 | Pichler | 89/4.1 |
| 2013/0174459 | A1 | * | 7/2013 | Moretti | 42/69.01 |
| 2014/0123527 | A1 | * | 5/2014 | Calvete | 42/51 |

FOREIGN PATENT DOCUMENTS

| | | |
|---|---|---|
| DE | 19810787 | 3/1998 |
| DE | WO 0022367 | 10/1998 |
| EP | 0408798 | 1/1991 |
| FR | 2765317 | 6/1997 |

OTHER PUBLICATIONS

ISA Written Opinion for PCT/AT2013/050020.
International Preliminary Report on Patentability for International Application No. PCT/AT2013/050020 dated Aug. 26, 2014.

* cited by examiner

FORWARD SET TRIGGER DEVICE

CROSS-REFERENCE TO RELATED APPLICATIONS

This application is a National Phase application of International Application No. PCT/AT2013/050020 filed Jan. 24, 2013 which claims priority to Austrian Utility Patent Application No. GM 50011/2012 filed Feb. 20, 2012, the disclosures of which are incorporated herein by reference.

BACKGROUND

The present invention relates to a forward set trigger device for a firearm, comprising a striking element that is acted upon by a main spring and has a catch interacting with a locking element, which can be disengaged from the catch by a trigger blade via a release mechanism.

Trigger devices with a forward setting function are known, e.g. from AT 338 658, DE 297 09 330 U1 or DE 33 01 754 A1, and serve to bring the trigger blade in an unstable cocked position with especially low trigger weight by a forward setting movement, or set trigger movement, for precision shots. On the other hand, uncocking mechanisms are known for a long time for conventional trigger devices to uncock the main spring for safety purposes. The invention at hand sets its aim to equip a forward set trigger device with a safe uncocking mechanism.

SUMMARY

This aim is achieved with a forward set trigger device of the type mentioned in the introduction, which is characterised by the novel combination of:

an uncocking mechanism for the main spring by means of which a main spring support facing away from the striking element can be brought into a position that uncocks the main spring; and a forward setting mechanism of a kind known per se, having a spring element which is articulated to the trigger blade and supported on a stop and which can be brought into an unstable cocked position during a forward setting movement of the trigger blade;

wherein the uncocking mechanism brings the spring element out of its unstable cocked position when the main spring support is moved into the uncocked position.

In this way the forward setting mechanism is uncocked ("un-set") while uncocking the main spring, so that the forward setting mechanism is uncocked in any case when recocking the firearm, thereby removing the danger of an accidental triggering of a shot. The safety of the forward set trigger device in use is thereby decisively increased.

According to a preferred feature of the invention, the main spring support has a nose which presses onto an adjusting screw of the trigger blade during uncocking to un-set the trigger blade, which yields a simple and effective safety mechanism.

Preferably said adjusting screw is accessible from the bottom side of the trigger blade, whereupon the uncocking mechanism of the forward setting mechanism can be adjusted to the uncocking mechanism of the striking mechanism without disassembling the weapon.

The forward set trigger device according to the invention can be combined with further features known per se from AT 336 658, according to which the stop of the spring element is adjustable via a screw and/or the unstable cocked position of the spring element is a biased beyond-dead center position and/or the spring element is a leaf spring, each ensuring an operation mode which is safe and not susceptible to breakdowns.

In a further preferred embodiment of the invention, the release member is mounted in a pivoting lever, which can be pivoted away from the locking element by means of the uncocking mechanism. Thereby faulty activations in the uncocked position can be prevented under all circumstances.

Preferably the uncocking mechanism has a cocking slide which moves the main spring support via a linkage, wherein especially preferably the cocking slide is lockable by means of a press button. Using a cocking slide for uncocking the forward setting mechanism enables a familiar usage for the user and requires only minor modifications at existing trigger devices to integrate the uncocking functionality according to the invention.

The forward set trigger device of the invention is suitable for all kinds of triggers, breeches and firearms, for example with striking elements of a firing pin or striking bolt type. A preferred application is a use with trigger devices with striking hammers, whose main spring support can be uncocked by a pivoting movement, which can be achieved by said cocking slide via a linkage.

BRIEF DESCRIPTION OF THE DRAWINGS

The invention will be explained in greater detail hereinafter on the basis of exemplary embodiments illustrated in the accompanying drawings, in which.

DETAILED DESCRIPTION

Figure 1:
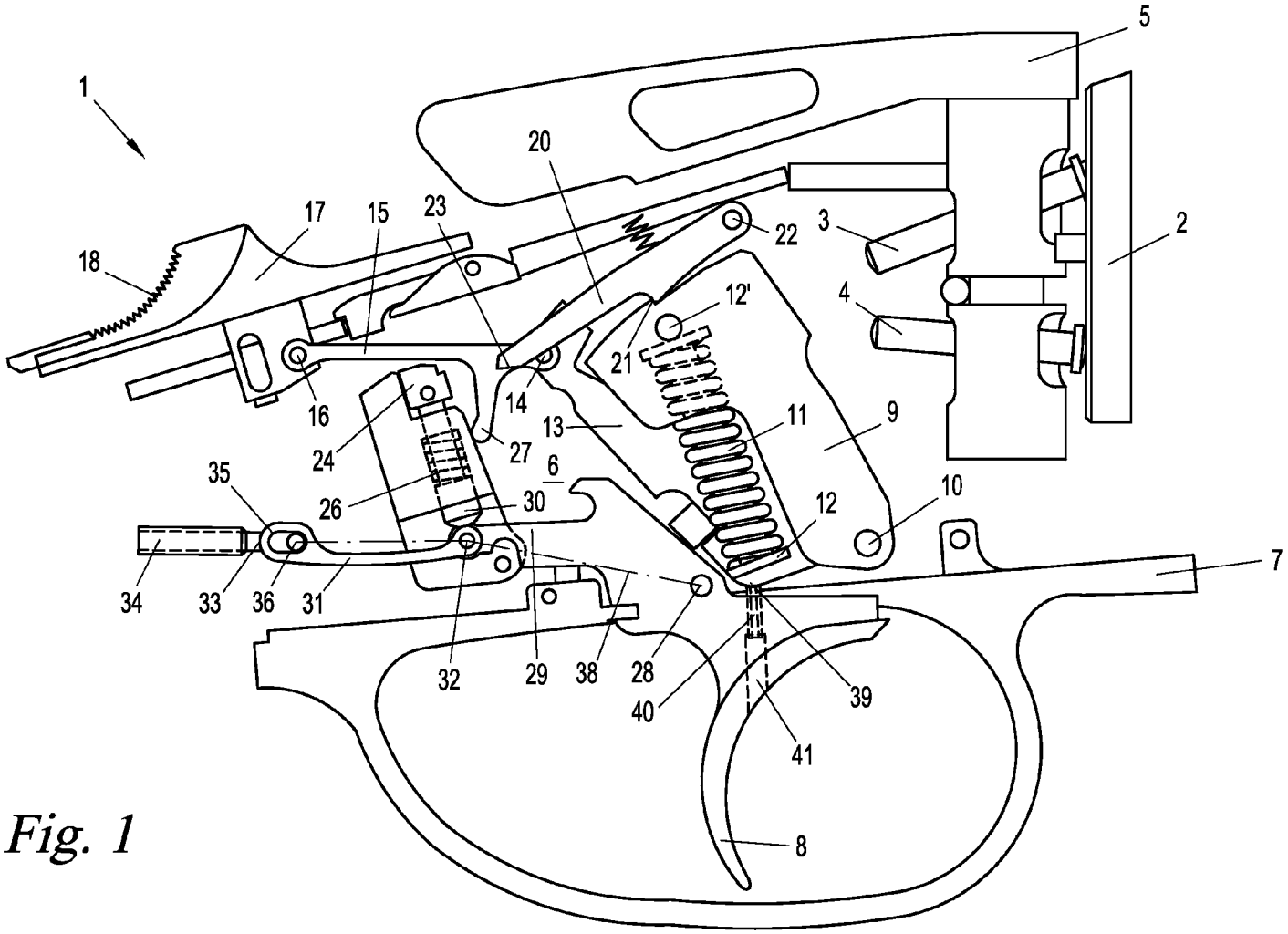
FIG. 1 shows the forward set trigger device of the invention in a schematic side view in the uncocked position of the main spring.
Figure 2:
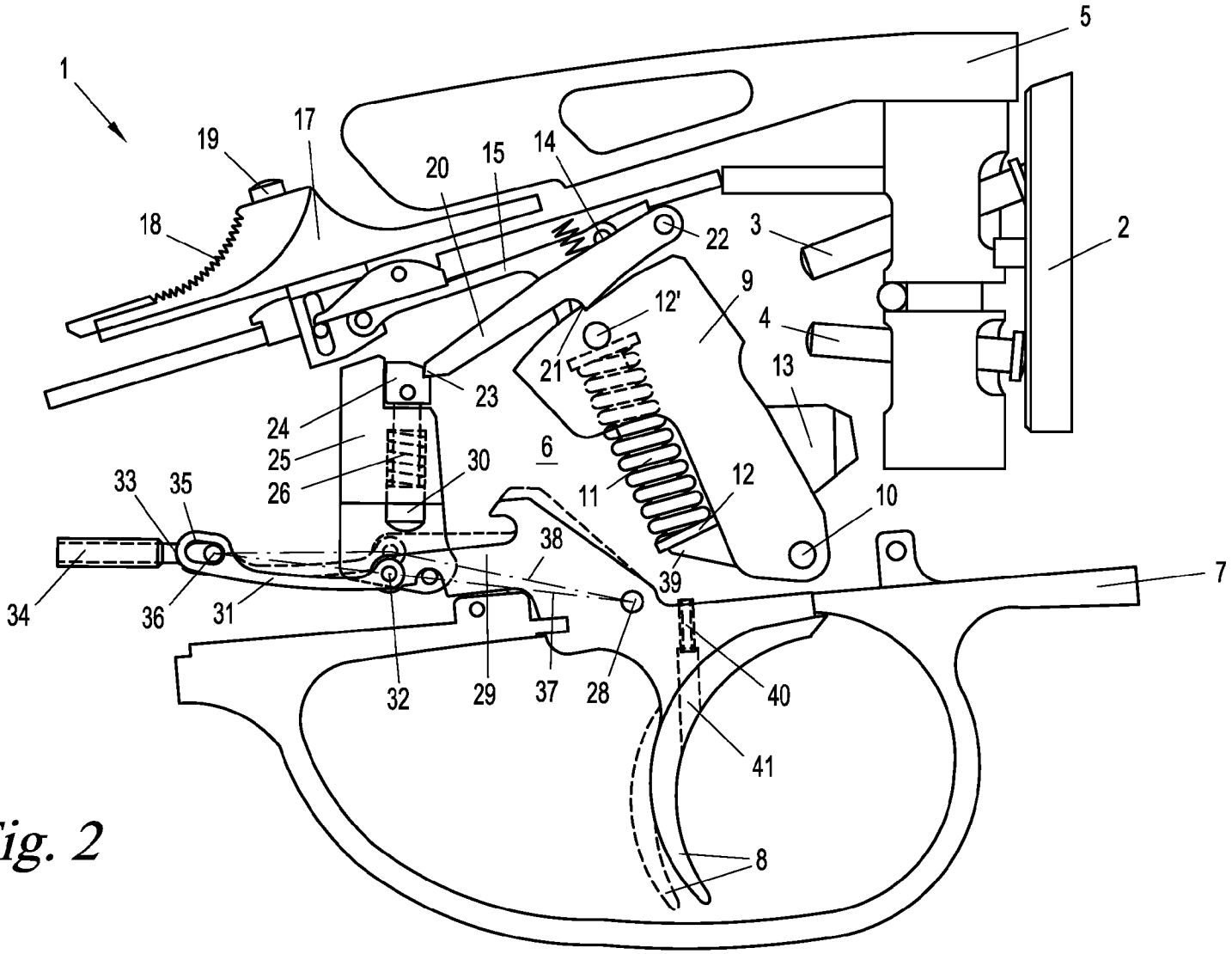
FIG. 2 shows the trigger mechanism of FIG. 1 in two different operating positions of the forward setting mechanism in the cocked position of the main spring.

In FIGS. 1 and 2 a forward set trigger device 1 for a firearm is shown, of which only a few parts are shown partially, like a double barrel 2 with firing pins 3, 4, an opening lever 5 for the barrels, a housing 6 for accommodating or mounting, respectively, the trigger device 1, and a safety lug 7 for the trigger blade 8. In the shown example, the firearm is an over/under shotgun-rifle with a bullet barrel and a pellet barrel; it is understood, however, that the trigger device 1 is suitable for all kinds of firearms, may it be single- or multi-barrel long arms, pistols, etc.

According to FIGS. 1 and 2, the trigger device 1 comprises a striking hammer 9, which is pivotably mounted about an axis 10 in the housing 6 and is acted upon by a strong main spring 11. The main spring 11 rests on its upper end against a ledge of the striking hammer 9 and on its lower end against a main spring support 12. The main spring support 12 is itself mounted movably with respect to the housing 6, by being formed on a first arm 13, which is on the one hand hinged on the axis 10 of the striking hammer 9 and on the other hand coupled at 14 with a second arm 15. The second arm 15 in turn acts on its other end at 16 on a cocking slide 17 linearly guided in the housing 6.

The cocking slide 17 protrudes in a known manner on the upper side of the housing of the weapon and can be slid via a gripping area 18 from the uncocked position shown in FIG. 1 forwardly into the cocked position shown in FIG. 2. During that, the cocking slide 17 pivots the main spring support 12 via the linkage 13, 15 about the axis 10 in the direction of the striking hammer 9, whereupon the main spring 11 lying therebetween is compressed and cocked. A press button mechanism 19 locks the cocking slide 17 in the forward-slid, cocked position of FIG. 2. By pressing the press button 19, the locking of the cocking slide 17 in FIG. 2 can be released and the cocking slide can be brought back into the uncocked position of FIG. 1.

In the cocked position of the main spring 11 (FIG. 2), the striking hammer 9 is held by a locking element 20 until the shot is fired, the locking element 20 engaging into a catch 21 of the striking hammer 9. In the example shown, the locking element 20 is a one-armed lever pivotably mounted at 22 in the housing 6. By lifting the end 23 of the lever, the locking element 20 is released or disengaged, respectively, from the catch 21, to trigger the striking of the striking hammer 9 under the force of the main spring 11, whereupon the bullet in the barrel 2 is struck by the firing pin 3 and the shot is fired.

For this reason, in the cocked position (FIG. 2) the end 23 of the lever of the locking element 20 is engaged from underneath by a release bolt 24, which is linearly guided in a pivoting lever or pendulum 25 against the force of a spring 26. As shown in FIG. 1, the second arm 15 of the linkage 13, 15 has an appendix 27, which presses away the pivoting lever 25 from the lever end 23 of the locking element 20 when the main spring 11 is uncocked, i.e. when the cocking slide 17 is slid back, whereby the release bolt 24 is disengaged from the locking element 20, which prevents an accidental firing of a shot in the uncocked position of FIG. 1.

In the cocked position of FIG. 2, in which the release bolt 24 rests on the locking element 20, the release bolt 24 can be actuated by the trigger blade 8, namely in two different ways: On the one hand, as a "normal" trigger (dashed position of the trigger blade 8 in FIG. 2), on the other hand as a forward set trigger (position of the trigger blade 8 depicted with solid lines in FIG. 2).

For the normal trigger function of the trigger blade 8 (dashed lines), the trigger blade 8 rests—with a trigger blade appendix 29 protruding from opposite of its pivot point 28 in the housing 6—tightly on the lower end 30 of the release bolt 24. In this position (see also function line 38) the release bolt 30 can be pressed up against the force of the spring 26 by drawing back the trigger blade 8 and thereby unlatching the locking element 20 from the catch 21 of the striking hammer 9 to fire the shot.

To activate the forward set trigger function, the trigger blade 8 is pressed forward from the dashed position as shown in FIG. 2 to the solid lined position as shown in FIG. 2 to prepare the firing of the shot, which movement is also referred to as "setting" the forward setting mechanism. The backward end of the trigger blade appendix 29 thereby moves down against the force of a spring element 31 into an unstable cocked position of the spring element 31. In the shown example, the spring element 31 is a leaf spring, which is hinged on its one end at 32 at the trigger blade appendix 29 and rests on its other end on a stop 33 of the housing 6. The stop 33 can, for example, be adjusted in its position with respect to the spring element 31 via a screw 34. The spring element 31 can additionally be held with clearance on a bolt 36, which is stationary with respect to the housing, by means of a long hole 35.

When setting the trigger blade 8, i.e. when moving the trigger blade appendix 29 down and distancing it from the lower end 30 of the release bolt 24, the spring element 31 is cocked or slightly bended (as a leaf spring) between the stop 33 and the hinge 32, until the points 33, 32 and 28 come into a stretched (or slightly overstretched) function line 37. This position constitutes an unstable force equilibrium, i.e. easily movable out of its stop position, of the kind of a biased beyond-dead center position. By slightly pressing the trigger blade 8 backwards, the stretched function line 37 is left and the unstable equilibrium is disturbed: The point 32 with the backward end of the trigger blade appendix 29 snaps up under the force of the spring element 31 and hits onto the lower end 30 of the release bolt 24, whereupon the locking lever 20 is disengaged from the striking hammer 9 and the shot is fired. In the forward set position, only a very small actuation weight is thus necessary to fire the shot.

The uncocking mechanism for the main spring 11, comprising i.a. the movable main spring support 12, the linkage 13, 15 and the cocking slide 17, is configured to uncock the forward set trigger mechanism of the trigger blade 8 while uncocking the main spring 11 (FIG. 2→FIG. 1). To this end, the uncocking mechanism 11-18 acts on the forward setting mechanism 31-38 of the trigger blade 8 to shift it from the set position (solid lines in FIG. 2) into the un-set position (dashed lines in FIG. 2; FIG. 1). This can result from any suited mechanical connection between the main spring uncocking mechanism 11-18 and the forward setting mechanism 31-38, for example a linkage, a motion link, a linear guiding, or similar.

In the shown example, the main spring support 12 therefor has a nose 39 on the lower side, which can press onto the upper side of the trigger blade 8, more precisely on a side of the trigger blade 8 opposite side of the appendix 29 with respect to the pivot point 28. Optionally, the trigger blade 8 can here contain an adjusting screw 40, which is accessible and adjustable from the lower side of the trigger blade 8 via an opening 41. The nose 39 of the main spring support 12 thereby presses on the adjusting screw 40 of the trigger blade 8 during uncocking of the main spring 11 and thereby simultaneously uncocks the forward setting mechanism 31-38.

In the uncocked position of FIG. 1, the main spring 11 as well as the spring element 31 are thus uncocked. Thereby it is ensured that the trigger blade 8 is in the un-set position (function line 38 and dashed lines in FIG. 2) when recocking the weapon.

Instead of a striking hammer 9, a different striking element can be used, e.g. a striking bolt with a striking lug as the catch 21. Instead of a spring element 31 embodied as a leaf spring, a tilting lever, arm or such, which is acted upon by a pressure spring, can be used. The forward setting mechanism could alternatively also be arranged at the side of the trigger blade 8 which is opposite to the pivot point 28, in which case the mechanical coupling between the uncocking mechanism and the forward setting mechanism acts on a corresponding other point of the trigger blade 8 or its forward setting mechanism. Also, instead of a cocking slide 17, a different kind of actuation element could be used for the uncocking mechanism, e.g. an uncocking lever or an uncocking wheel. Instead of a pivoting movement, the main spring 11 could, for example, also be uncocked by a linear movement, by mounting the main spring support 12 linearly movable.

The invention is thus not limited to the presented embodiments, but encompasses all variants and modifications thereof that fall within the scope of the appended claims.

What is claimed is:

1. A forward set trigger device for a firearm, comprising:

a striking element that is acted upon by a main spring and has a catch interacting with a locking element, which locking element can be disengaged from the catch by a trigger blade via a release member, an uncocking mechanism for the main spring by means of which a main spring support facing away from the striking element can be brought into a position that uncocks the main spring, and a forward setting mechanism having a spring element, which spring element is articulated to the trigger blade and supported on a stop and can be brought into an unstable cocked position during a forward setting movement of the trigger blade, wherein the uncocking mechanism is configured to bring the spring element out of the unstable cocked position when the main spring support is moved into uncocked position, and wherein the main spring support has a nose which presses onto an adjusting screw of the trigger blade during uncocking the main spring.

2. The forward set trigger device according to claim 1, wherein the adjusting screw is accessible from the bottom side of the trigger blade.

3. The forward set trigger device according to claim 1, wherein the stop of the spring element is adjustable via a screw.

4. The forward set trigger device according to claim 1, wherein the unstable cocked position of the spring element is a biased beyond-dead center position.

5. The forward set trigger device according to claim 4, wherein the spring element is a leaf spring.

6. The forward set trigger device according to claim 1, wherein the release member is mounted in a pivoting lever, which can be pivoted away from the locking element by means of the uncocking mechanism.

7. The forward set trigger device according to claim 1, wherein the release mechanism has a cocking slide which moves the main spring support via a linkage.

8. The forward set trigger device according to claim 7, wherein the cocking slide is lockable by means of a press button.

9. The forward set trigger device according to claim 1, wherein the striking element is a striking hammer.

10. A forward set trigger device for a firearm, comprising:

a striking element, a main spring biased against the striking element, the striking element including a catch engaged with a locking element, the locking element being disengaged from the catch by a movement of a trigger blade via a release member, an uncocking mechanism for the main spring comprising a main spring support pivotally movable away from the striking element into a position that uncocks the main spring, and a forward setting mechanism including a spring element, the spring element being hingedly coupled to a trigger blade appendix at one end and supported on a stop at an opposite end, the spring element forcing the trigger blade appendix into an unstable cocked position during a forward setting movement of the trigger blade, wherein the uncocking mechanism is adapted to move the spring element out of the unstable cocked position when the main spring support is moved into an uncocked position, and wherein the trigger blade further includes an adjusting screw extending through an opening in the trigger blade, the adjusting screw pressing against a nose provided at a lower end of the main spring support when the main spring is in the uncocked position.

11. The forward set trigger device according to claim 10, wherein the adjusting screw is accessible from the bottom side of the trigger blade.

12. The forward set trigger device according to claim 10, wherein the stop of the spring element is adjustable via a screw.

13. The forward set trigger device according to claim 10, wherein the unstable cocked position of the spring element is a biased beyond-dead center position.

14. The forward set trigger device according to claim 13, wherein the spring element is a leaf spring.

15. The forward set trigger device according to claim 10, wherein the release member is mounted in a pivoting lever, which can be pivoted away from the locking element by means of the uncocking mechanism.

16. The forward set trigger device according to claim 10, wherein the release mechanism has a cocking slide which moves the main spring support via a linkage.

17. The forward set trigger device according to claim 16, wherein the cocking slide is lockable by means of a press button.

18. The forward set trigger device according to claim 10, wherein the striking element is a striking hammer.

* * * * *